United States Patent [19]

Hartland

[11] 4,456,252

[45] Jun. 26, 1984

[54] TENNIS SERVICE PRACTICE COURT WITH RECOVERING AND COLLECTING MEANS

[76] Inventor: Albert C. Hartland, 1738 Nocturne, Houston, Tex. 77043

[21] Appl. No.: 302,046

[22] Filed: Sep. 14, 1981

[51] Int. Cl.[3] ..... A63B 61/00

[52] U.S. Cl. ..... 273/29 A

[58] Field of Search ..... 272/3; 273/29 R, 29 A, 273/26 R, 35 B, 176 K, 179 R, 395, 396, 397, 411; 124/49, 50, 51 R, 51 A

[56] References Cited

U.S. PATENT DOCUMENTS

| | | | |
|---|---|---|---|
| 3,602,506 | 8/1971 | Gentiluomo | 273/176 K |
| 3,697,068 | 10/1972 | McDougall | 273/29 A |
| 3,738,664 | 6/1973 | Peeples | 273/176 K |
| 3,989,245 | 11/1976 | Augustine, Jr. et al. | 124/51 A |
| 3,989,246 | 11/1976 | Brown et al. | 273/29 A |
| 4,116,436 | 9/1978 | Björhn | 273/29 R |

FOREIGN PATENT DOCUMENTS

| | | | |
|---|---|---|---|
| 29821 | 6/1981 | European Pat. Off. | 273/29 A |
| 2643790 | 3/1978 | Fed. Rep. of Germany | 273/29 A |

*Primary Examiner*—Richard T. Stouffer
*Assistant Examiner*—William H. Honaker
*Attorney, Agent, or Firm*—Neal J. Mosely

[57] ABSTRACT

A practice tennis court for practicing serving the tennis balls consists of the complete forward or receiving part of a tennis court back to the net and only the service area beyond the net. Immediately behind the service area is an end net or other backstop to stop the balls without rebounding. At the net, there is a continuous rake extending across the court for sweeping used balls to the back of the service area. At the rear end of the service area adjacent to the collection net is a trough with an endless belt running from side to side to remove the spent balls to a collection point. At the end of use of the court or after play of a selected number of balls, the rake is moved from the net area to sweep the spent balls underneath the collection net and into the trough for removal. A preferred arrangement would provide several of these courts side by side with the collection trough and belt extending across all of the practice courts.

9 Claims, 2 Drawing Figures

TENNIS SERVICE PRACTICE COURT WITH RECOVERING AND COLLECTING MEANS

BACKGROUND OF THE INVENTION

1. Field of the Invention

This invention relates to new and useful improvements in practice tennis courts and more particularly to a court for practicing serving.

2. Description of the Prior Art

Various types of apparatus and various arrangements of tennis playing facilities have been provided in the past for practicing the game of tennis.

Sawyer U.S. Pat. No. 3,203,696 discloses an apparatus for projecting tennis balls toward a player for use in practicing the game of tennis.

Graves U.S. Pat. No. 3,858,880 discloses a practice tennis range having a common central receiving court and a plurality of individual stroke courts.

Worthington U.S. Pat. No. 3,948,512 discloses a recreational facility incorporating a plurality of tennis courts positioned radially from a common point. There is a slight overlap between adjacent courts using this construction.

Schain U.S. Pat. No. 3,966,205 discloses a practice serving arrangement for tennis which includes a net having a collecting pocket and arranged to be positioned on the opposite end of the court from the person practicing serves.

Hodges U.S. Pat. No. 4,025,071 discloses a tennis ball feeder for use in practicing the game of tennis.

Kreuzman U.S. Pat. No. 4,204,679 discloses a tennis practice serving net which is mounted on wheels and adjustable along a service practice area.

SUMMARY OF THE INVENTION

One of the objects of this invention is to provide an improved arrangement for practicing the serving of a tennis ball.

Another object of the invention is to provide an improved arrangement for practicing serving which has a novel means for collecting and returning the balls used.

A further object of this invention is to provide an improved practice tennis court consisting of a full half court on the player's side of the net and only the service area on the opposite side of the net.

Other objects of this invention will become apparent from time to time throughout the specification and claims as hereinafter related.

These and other objects of this invention are accomplished by a practice tennis court for practicing serving the tennis balls which consists of the complete forward or receiving part of a tennis court back to the net and only the service area beyond the net. Immediately behind the service area is an end net or other backstop to stop the balls without rebounding. At the net, there is a continuous rake extending across the court for sweeping used balls to the back of the service area. At the rear end of the service area adjacent to the collection net is a trough with an endless belt running from side to side to remove the spent balls to a collection point. At the end of use of the court or after play of a selected number of balls, the rake is moved from the net area to sweep the spent balls underneath the collection net and into the trough for removal. A preferred arrangement would provide several of these courts side by side with the collection trough and belt extending across all of the practice courts.

DESCRIPTION OF THE PREFERRED EMBODIMENT

Figures 1, 2:
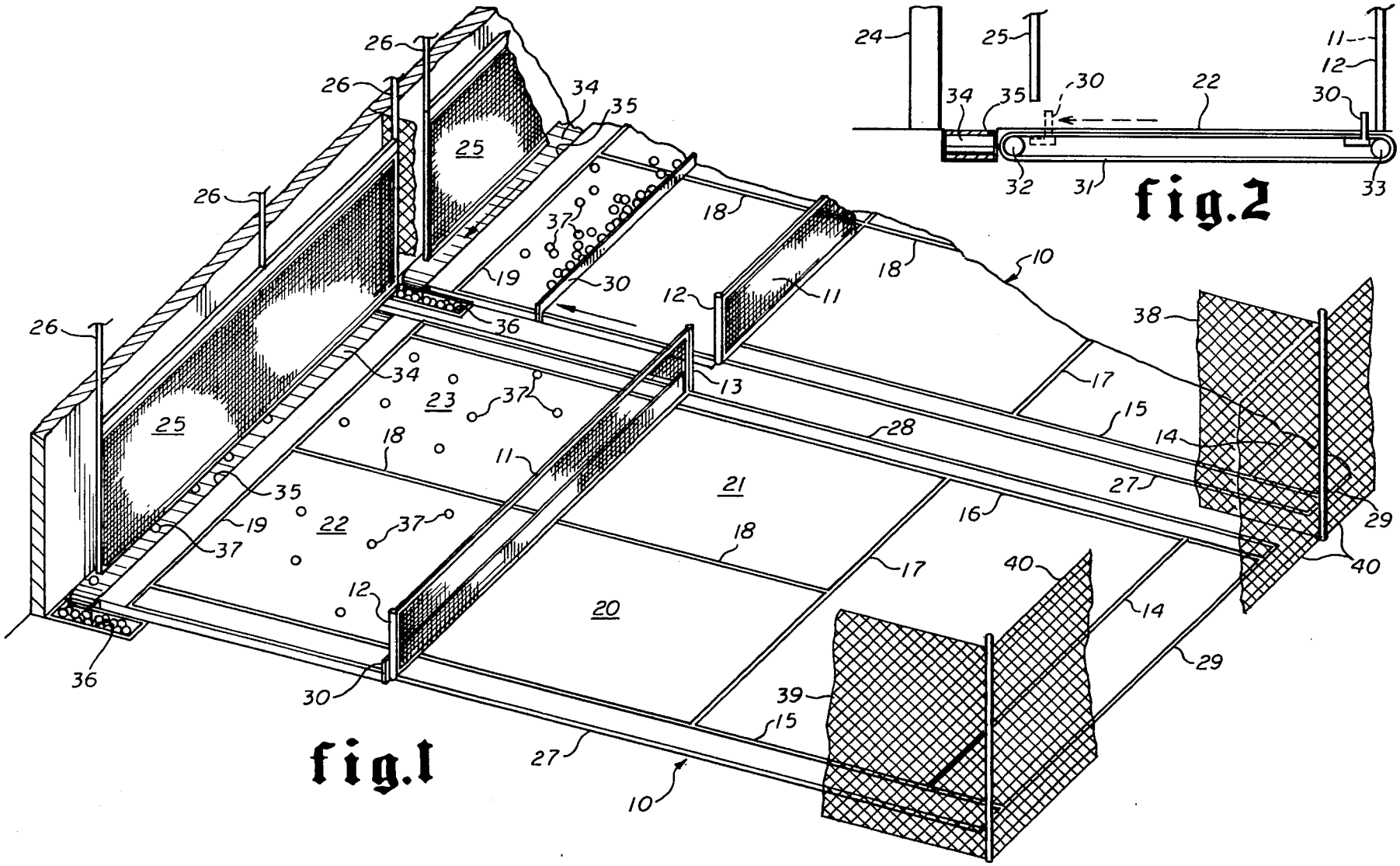
FIG. 1 is an isometric view of a practice tennis court and associated apparatus representing a preferred embodiment of the invention.
FIG. 2 is a sectional view illustrating the apparatus for moving a ball-collecting rake shown in FIG. 1.

In the drawings, there is shown a practice tennis court for practicing serving a tennis ball. The court and associated apparatus which is shown is designed for installation in office buildings or the like to provide an area for recreation and exercise. This practice court can also be installed in specially designed recreational areas outside or in recreational buildings or enclosures.

Referring to the drawings, and more particularly to FIG. 1, there is shown a preferred embodiment of this invention which consists of a practice tennis court 10 which is specially designed for practicing serving the ball. Service practice court 10 is laid out on any suitable playing surface and has a conventional tennis net 11 supported between vertically extending posts 12 and 13.

The front part of practice court 10, extending to the right of net 11 in FIG. 1, consists of one half, viz. the receiving half, of a regulation tennis court. This one half court has a base line 14 and side lines 15 and 16 which define the boundaries of the court. A service line 17 is positioned at the regulation distance. A center dividing line 18 extends from the mid point of service court line 17 past net 11 to the far end of the practice area.

The end of practice court 10 beyond, or to the left of net 11 consists of a partial court extending only to the service court line 19. The service area extending from net 11 to service court line 19 is divided into the normal service areas by center line 18. The court as shown therefore consists of a left hand inner service area 20 and a right hand inner service area 21; and a left hand outer service area 22 and a right hand outer service area 23.

At the rear of practice court 10, just beyond the outer service areas 22 and 23, there is provided a suitable vertical wall 24. A net 25 is hung a short distance in front of wall 24 by ropes 26. Net 25 is supported about ten inches above the surface of the court and about two feet from rear wall 24. The end net is about eight feet high to provide a surface for catching spent balls and to prevent their rebounding back into the playing area.

The left hand limit of court 10 is defined by left side line 27 and the right hand limit by right side line 28. Side lines 27 and 28 extend back to the rear boundry line 29. Supporting posts 12 and 13 are positioned at the side lines 27 and 28. A moveable rake 30 is positioned at the net 11 and extends from side to side across the entire width of practice court 10. Rake 30 is of a height such that it may pass under the lower end of net 25. Rake 30 is connected to a suitable operating means which is shown in FIG. 2 as a reversibly movable chain or belt 31 carried on suitable wheels or pulleys 32 and 33. Rake 30 is reversibly movable from its initial position adjacent to net 11 to a position just under the end of the back net 25.

At the back of practice court adjacent wall 24 there is provided a continuously moving belt 34 positioned in a trough 35. Belt 34 and trough 35 extend laterally or transversely of the practice court adjacent wall 24 and are operable to collect spent balls and move the same to a container or reservoir 36.

The practice court arrangement just described may be constructed as a single court or may be arranged as a plurality of practice courts in side to side relation. In FIG. 1, there is shown a second court to the right of the one completely described. Where two or more courts are utilized in side to side relationship the transversely moving conveyor belts 34 may be arranged to move the spent tennis balls to containers 36 adjacent each of the respective courts or, if desired, a single continuously moving belt may move the spent tennis balls to a single collection point out of the playing area where the balls are returned to the players or provided for new players wishing to use the practice area.

The materials of construction used in this practice court and the dimensions of the various components are preferably suitable to define a regulation court and to provide playing conditions which are comprable to those encountered in normal play. The outside walls 38 and 39 surrounding the playing area and the rear wall 40 (shown broken) are preferably at least eight feet high and if the practice court is installed in a building the ceiling should be at least ten feet hight to allow for lights and air conditioning.

The outside walls, in the case of an outdoor structure, may be of CYCLONE, or equivalent, fence or may be of other suitable light weight firm material. The surface of the playing court 10 can be of concrete, wood or other firm playing surface material. The lines are marked by any suitable means for laying out the playing lines for a regulation playing court. The distances between the lines correspond to the regulation distances for the lines on a regulation playing court. Thus, the length of base line 14 is twenty-seven feet. The distance from base line 14 to service court line 17 is eighteen feet.

Center line 18 extends parallel to the left and right hand lines 15 and 16 from the mid pint of service court line 17. The distance from service court line 17 to the net 11 is twenty-one feet. A two foot clearance is provided on either side between lines 15 and 27 and lines 16 and 28, respectively. Net 11 is of regulation materials and regulation height as are posts 12 and 13. The end net 25 may be of any suitable material and is preferably about eight feet high and suspended at least ten inches above the rear end of the playing court. The rake 30 is movable by a suitable control means (not shown) to sweep the spent tennis balls to the rear of the court for removal by continuously moving belt 34 to collection container 36.

USE OF PRACTICE COURT

Practice court 10, as described above, is used for the full purpose of practicing serving the ball at the game of tennis. The near or forward half of the practice court corresponds exactly to the serving end of a regulation court. A player who is using practice court 10 will stand at the normal position at the base line and practice serving balls 37 over net 11 into service area 22 or 23, depending upon the position from which service is begun. This practice court is used for practicing the service of the tennis balls 37 in the same manner as practice would be carried out on a regulation court. The balls which clear net 11 and pass into service areas 22 or 23 may rebound against net 25 and fall to the surface of the court. Also, some of the balls used in practice may rebound somewhat into the serving areas.

The player practicing in this court would ordinarily be given a selected number of the balls 37 for practice at a suitable charge made for the use of the balls. When the player has completed serving the balls, it is necessary to have the balls collected and returned to a suitable collection point. The balls which have struck net 25 and fall to the rear surface may fall on moving belt 34 and be conveyed to collection reservoir 36. The balls which remain on the surface of the practice court are swept by rake 30 to the rear of the court and onto conveyor belt 34.

Rake 30 is operated by a suitable control switch or the like and is moved to sweep the balls to the rear of the court and then returned automatically to its initial starting position against supporting posts 12 and 13 for net 11. This operation of rake 30 is operable to clear the rear serving areas 22 and 23 of balls 37 and move the balls into troughs 35 and onto conveyor belt 34 for movement to collection point 36. Once the balls have been collected in collection point 36 they are recovered by the attendant or other person in charge of dispensing the balls for further play.

While this invention has been described fully and completely with emphasis upon a single preferred embodiment it should be understood that within the scope of the appended claims the invention may be practiced otherwise than as specifically described herein.

I claim:

1. A service practice court for tennis comprising a flat surface marked with lines defining a portion of a regulation tennis court, supporting posts and a tennis net supported therebetween on said surface, said lines including longitudinally and transversely extending lines defining the complete front or receiving half of a regulation tennis court in front of said posts and net and including lines consisting only of the sidelines and the service line defining only the service area of the court beyond said posts and net, and said service area being unobstructed for service practice and the space above said service area being unobstructed to the maximum height of the normal path of service of a tennis ball, backstop means comprising a net hung vertically across said court just behind said service line beyond said posts and net to stop the movement of practice tennis balls at that point without obstructing said service area and the space thereabove, and collecting and recovering means positioned adjacent and immediately behind said net and operable to move spent tennis balls along the entire width of the court to the rear of the court to a point beyond the rear service line for return of the spent balls to the player for further service practice.

2. A tennis service practice court according to claim 1 in which said collecting and recovering means comprises a movable conveyor belt for moving said spent tennis balls parallel to the net at the service line end of said court.

3. A tennis service practice court according to claim 2 in which said surface includes a transversely extending trough in which said conveyor belt is positioned.

4. A tennis service practice court according to claim 3 in which said surface includes a collection reservoir at the end of said conveyor belt for receiving spent tennis balls conveyed thereby.

5. A tennis service practice court according to claim 2 in which said collecting and recovering means includes ball sweeping means to sweep spent balls from beyond said posts and net onto said conveyor belt.

6. A tennis service practice court according to claim 5 in which said ball sweeping means comprises a rake extending across the entire width of said court and positioned initially adjacent to said net, and means to move said rake from said initial position to a position adjacent to said conveyor belt and back to said initial position.

7. A tennis service practice court according to claim 1 including means to collect and recover spent practice tennis balls comprising a movable conveyor belt for moving said spent tennis balls transversely from the service line end of said court, said surface includes a transversely extending trough in which said conveyor belt is positioned and a collection reservoir at the end of said conveyor belt for receiving spent tennis balls conveyed thereby, means to sweep spent balls from beyond said posts and net onto said conveyor belt comprising a rake extending across the entire width of said court and positioned initially adjacent to said net, and means to move said rake from said initial position to a position adjacent to said conveyor belt and back to said initial position.

8. A plurality of tennis service practice courts according to claim 7 positioned in side to side relation with said conveyor belt extending across all of said courts and a single reservoir provided at the end thereof.

9. A plurality of tennis service practice courts according to claim 1 positioned in side to side relation.

* * * * *